United States Patent [19]

Neroni et al.

[11] Patent Number: 4,473,923

[45] Date of Patent: Oct. 2, 1984

[54] VACUUM CLEANING TOOL ADAPTER WITH ELECTRICAL CONTROL MEANS

[75] Inventors: Peter J. Neroni; Robert E. Stevens; Joe L. Byers, all of Kettering, Ohio

[73] Assignee: Dayco Corporation, Dayton, Ohio

[21] Appl. No.: 376,973

[22] Filed: May 10, 1982

[51] Int. Cl.[3] ..... A47L 5/36

[52] U.S. Cl. ..... 15/377; 174/47; 339/15

[58] Field of Search ..... 15/377; 174/47; 339/15, 339/16 R

[56] References Cited

U.S. PATENT DOCUMENTS

| | | | |
|---|---|---|---|
| 3,579,706 | 5/1971 | Hetland | 15/327 |
| 3,588,943 | 6/1971 | Hetland | 15/327 |
| 3,636,285 | 1/1972 | Wickham et al. | 174/47 X |
| 3,733,697 | 5/1973 | Wickham et al. | 29/628 |
| 4,018,493 | 4/1977 | Lyman et al. | 339/15 |
| 4,052,767 | 10/1977 | Dutcher | 15/377 |
| 4,063,790 | 12/1977 | Kleykamp et al. | 339/16 R |
| 4,168,564 | 9/1979 | Grabovez | 15/377 |
| 4,188,081 | 2/1980 | Holden et al. | 339/15 |
| 4,277,640 | 7/1981 | Kutnyak et al. | 174/47 |
| 4,283,594 | 8/1981 | Somers | 174/47 |

*Primary Examiner*—Chris K. Moore

*Attorney, Agent, or Firm*—Joseph V. Tassone

[57] ABSTRACT

A vacuum cleaning tool adapter for vacuum cleaning systems having a control device incorporated within the adapter. The control device includes an electrical switch and may also include other circuit control devices. Also incorporated in the adapter is a connect-disconnect connector for mechanically interengaging the adapter with a hose assembly leading to the vacuum cleaner, which also provides electrical continuity from the adapter through current conducting reinforcing members in the hose assembly and into the vacuum cleaner. The adapter provides for electrically connecting the cleaning tool into the system, and the switch is used to turn the power on and off from the vacuum cleaner motor to the cleaning tool. An additional switch may also be located in the adapter for controlling the vacuum cleaner motor itself.

27 Claims, 7 Drawing Figures

VACUUM CLEANING TOOL ADAPTER WITH ELECTRICAL CONTROL MEANS

BACKGROUND OF THE INVENTION

1. Field of the Invention

The invention relates to a vacuum cleaning system having a vacuum cleaner, particularly of the canister or tank type. Some of these cleaners are designed so that a hose assembly is attached to the tank at one end and a powered cleaning tool is attached at the other end of the hose assembly, with the motor in the tank providing the vacuum through the hose into the cleaning tool. The hose assembly is of the type having a cylindrical hose body which is reinforced by spaced helical coils that also serve as electrical conductors.

2. Prior Art Statement

Various devices for controlling power to powered vacuum cleaning tools, by utilizing an on-off switch, have been devised. Such switches have been mounted in the end connectors of the hose, such as shown in two inter-related patents to Wickham et al, U.S. Pat. Nos. 3,636,285 and 3,733,697, and in U.S. Pat. No. 4,277,640 to Kutnyak et al. It has also been known to install a fault interrupter device, as shown in Somers U.S. Pat. No. 4,283,594, and a thermal overload device as shown in Grabovez U.S. Pat. No. 4,168,564; both devices serving to disconnect power to a cleaning tool in the event problems are detected. Both these devices are also installed in the end connectors of the hose. It is also known to mount such a switch on a permanently assembled hose and handle as shown in Hetland U.S. Pat. Nos. 3,579,706 and 3,588,943.

In order to complete the electrical circuit from the vacuum cleaner to the cleaning tool, it has been a preferred practice to use a cord and plug arrangement, often called a "pigtail", such as shown in the Wickham, Somers and Grabovez patents, and as also shown in Kleykamp et al, U.S. Pat. No. 4,063,790. This pigtail is used both as a connector from the vacuum cleaner to the hose, and from the hose to the cleaning tool. At the same time, some type of mechanical interengagement is used in the above patents to lock the assemblies together while conveying air from the vacuum cleaner to the cleaning instrument. In one instance, an intermediate member is provided between the hose assembly and cleaning tool to provide both mechanical and electrical interengagement. This is shown in Holden et al, U.S. Pat. No. 4,188,081.

SUMMARY OF THE INVENTION

It is a feature of this invention to provide a novel adapter for cleaning tools remote from a vacuum cleaner having the power unit for the vacuum cleaning system. The adapter consists of a polymeric molded body and a metal or polymeric air-conducting member interengaged with the body. The adapter has an on-off switch incorporated in the body which is used to control the power cleaning tool.

It is another feature of the invention to provide other devices within the adapter body, particularly a ground fault circuit interrupter or a thermal overload unit which automatically shut off power to the cleaning tool in the event a problem of this type is detected. Such a device is used in conjunction with the switch.

Another feature of the invention provides for means on the adapter for interlocking the adpater with an adjacent hose assembly to provide electrical continuity from the adapter, through the hose, and into the vacuum cleaner.

A further feature provides for a hose and cleaning tool adapter assembly in which the hose assembly can be repeatedly connected to or disconnected from the adapter to make or discontinue electrical continuity.

Another feature of the invention provides an adapter and method of making same, in which the adapter consists of a molded body which contains the switch and special devices, as well as the mechanical and electrical continuity means, and an air-conducting member interengaged with the body.

It can be seen that this novel invention provides a switch control for the vacuum cleaning system that operates the remote power cleaning tool which is located in the cleaning tool adapter, rather than in the hose connector or in a permanent hose-wand assembly, as in the prior art. The invention also provides for the special devices to be located in the adapter, rather than in the hose connector. The invention further provides the means to mechanically interlock with the hose and provide electrical continuity, to be located in the cleaning tool adapter rather than being a separate cord and plug device as in the prior art.

The invention also provides as an option, additional switch means which may be in the form of a separate switch or combined with the principal switch; this additional switch means also incorporated within the adapter and used to conyrol the vacuum cleaner motor itself. Such an arrangement is not present in prior art control devices.

Whether one or both switch devices are used, the user will find operation of the vacuum cleaner to be greatly enhanced because the switches are located conveniently to the hand of the user so that power to the vacuum cleaner as well as to the power cleaning tool may be quickly and easily controlled. This may be especially convenient if the user is some distance away from the canister, so that it will not be necessary to walk back to the canister to turn off the power, as is required in prior art arrangements.

A further advantage of the present arrangement is that the hose assembly is simpler to manufacture than in the Wickham devices, for example. The end couplings can again be manufactured as in the Kleykamp patent, with the desired switches or other control devices all incorporated within the adapter. This permits the vacuum cleaner manufacturer to stock various types of adapters which may be interchangeably used with the standard hose assembly.

Other objects, uses and advantages of this invention are apparent from the following description and the accompanying drawings.

DESCRIPTION OF THE PREFERRED EMBODIMENTS

Figure 1:
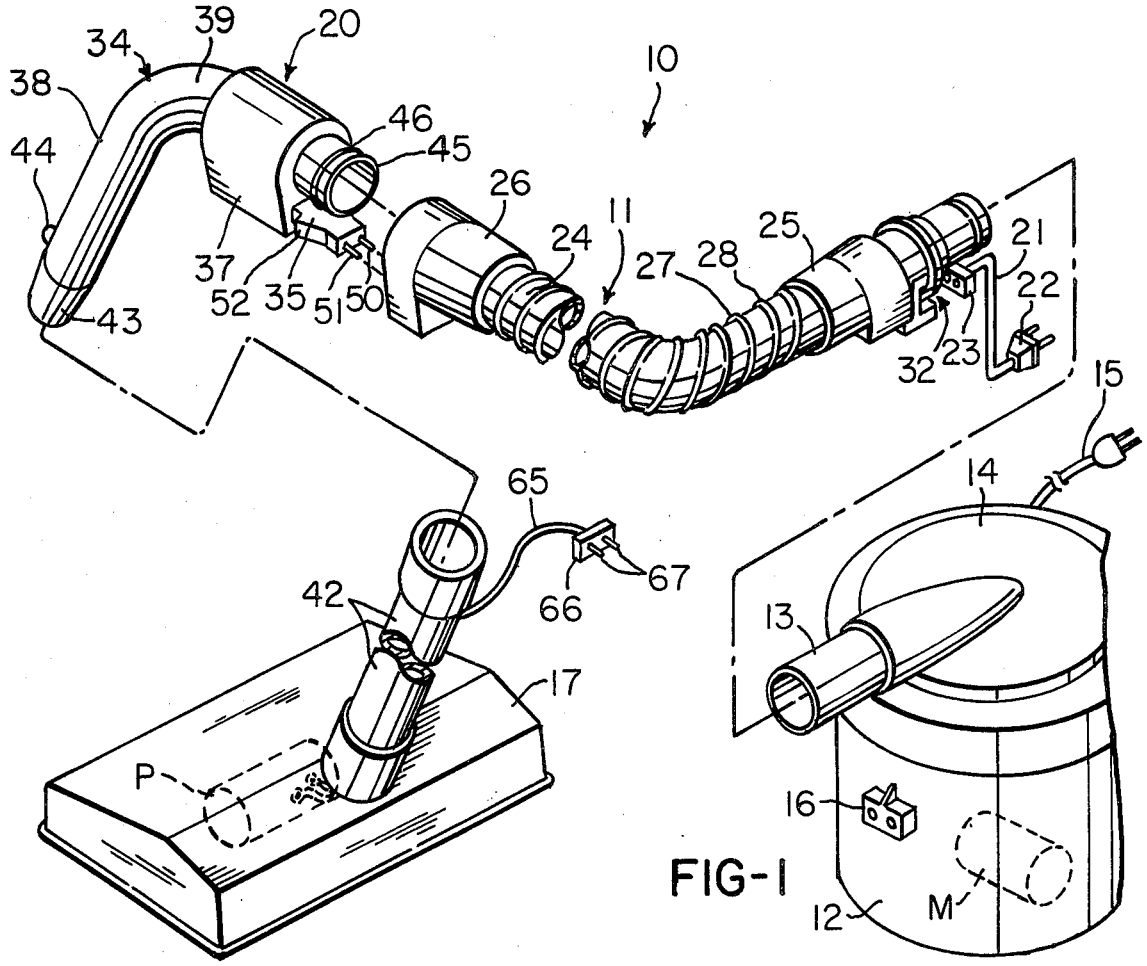
FIG. 1 is a perspective view of the vacuum cleaning system illustrating a typical canister or tank type vacuum cleaner, hose assembly, power cleaning tool adapter, and power cleaning tool, shown in exploded arrangement.

Reference is now made to FIG. 1 of the drawing which illustrates an exemplary canister type vacuum cleaning system which is designated generally by the reference numeral 10 and utilizes one exemplary embodiment of a vacuum hose assembly 11 of this invention. The vacuum cleaning system 10 has a canister or tank type vacuum cleaner 12 which is provided with a vacuum tube 13 which extends outwardly from the top portion 14 thereof. The vacuum cleaner 12 is provided with an electrical motor receiving electrical power through a cord assembly 15 which is particularly adapted to be plugged in a known manner into a suitable power source. The cleaner 12 has an integral vacuum unit produced by the motor M which is provided in accordance with techniques known in the art and because such vacuum unit is of conventional construction it will not be shown or described.

The vacuum cleaner has a female power receptacle 16 disposed on the outside surface of its tank 12 for ready access thereto. The receptacle 16 is used to supply electrical power through the hose assembly 11 into the adapter 20, and then to motor P of the power cleaning tool 17 which is also operatively connected to the vacuum system itself through the adapter and the hose assembly, through tube 13 and into the vacuum cleaner 12. The vacuum cleaner has an electrical cord assembly 21 which is provided with a male fitting 22 at one end thereof for connection to the receptacle 16 and the cord assembly 21 has a female fitting 23 at its opposite end which is adapted to be electrically connected to the hose assembly 11 once the assembly 11 is connected to the cleaner 12; and, as will be described in detail subsequently.

The hose assembly 11 comprises a vacuum hose 24 and a pair of hose connectors 25 and 26 provided at opposite end portions of the hose 24. The hose connectors 25 and 26 may be fixed on opposite end portions of the vacuum hose 24 utilizing any suitable technique known in the art and preferably such hose connectors are molded in position to define the hose assembly 11 as an integral unit, such as described for example in the Wickham patents referred to above.

The hose assembly 11 also has a plurality of wires, and in this example of the invention a pair of wires 27 and 28 which extend along the vacuum hose 24; and, the wires 27 and 28 serve the dual purpose of electrical conductors and hose reinforcing wires as is known in the art. Each of the dual-purpose wires 27 and 28 consists of a central member which is suitably coated or covered with an associated insulating sleeve. Each central member is preferably made of a ferrous metal, or the like, and is clad with a material, such as copper, which has better electrical conductivity than the ferrous metal. In addition to conducting electricity from one end of the hose assembly 11 to the other the wires 27 and 28 prevent collapse of the vacuum hose 24 and as is known in the art.

The hose assembly 11 has an electrical connector associated with each of its hose connectors. In this example of the invention a male electrical connector 32 is provided at one end of the hose assembly 11 and is an integral part of the hose connector 25. Electrical continuity is provided from the vacuum cleaner motor through the assembly 21 and connector 32 and the wires 27 and 28 through suitable connectors as shown in Wickham, and into the hose connector 26.

The adapter 20 serves multiple purposes; it transmits vacuum from the vacuum cleaner 12 through the hose assembly 11, by means of an air-conducting member 34. The adapter also has an electrical interlocking member 35 which interlocks mechanically with the hose connector 26, and also provides the electrical continuity referred to above. The member 34 is secured to the cleaning tool to pass the vacuum from that tool through the system, and the adapter has a body 37 containing an electrical plug 36 into which the cleaning tool is plugged. The body 37 further incorporates the switch for controlling the powered cleaning tool, and also contains the above-mentioned member 34. It may also contain the switch for controlling the vacuum cleaner motor, and may further contain other safety devices, such as thermal overload or ground fault circuit interrupter. Thus all these switches, devices and members are removed from the hose assembly and placed in a single unit which promotes versatility in the system. The adapter can easily be connected and disconnected from the base assembly at will.

Figure 2:
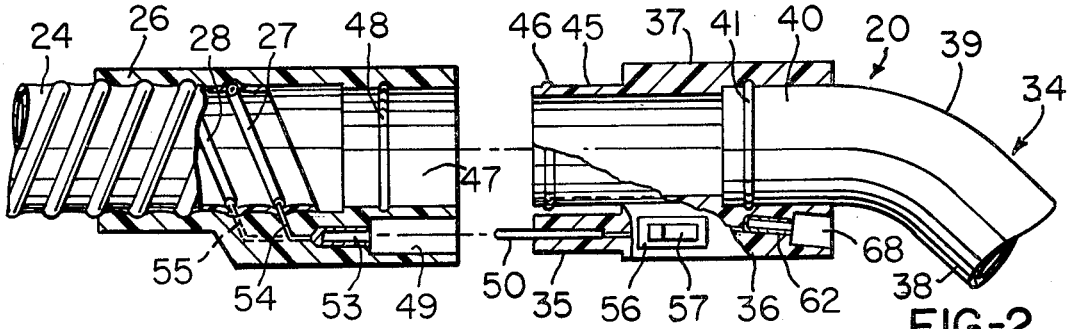
FIG. 2 is an enlarged side elevational view, with parts broken away and parts in cross-section, illustrating the hose assembly and adapter prior to interconnecting, illustrating details thereof.
Figure 3:
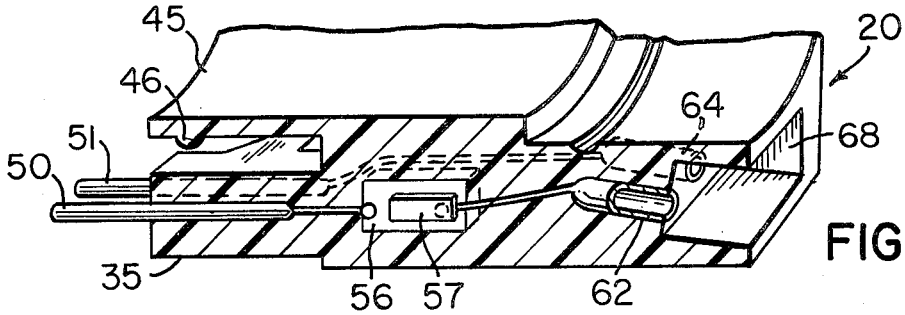
FIG. 3 is an enlarged sectional view of the novel adapter illustrating a typical power cleaning tool switch incorporated therein.

The construction of the adapter 20 and its relationship with the other parts of the system are best shown in FIGS. 2 and 3. The adapter comprises a body 37 which is preferably made of a high impact resistant, rigid polymeric material, such as ABS, and an air-conducting member 34, which may be made of a similar polymeric material or a metal such as steel. The member 34 is of hollow tubular construction for conveying vacuum through the system, and is preferably incorporated into the body 37 during an initial molding process which forms the body in a conventional mold while the member 34 is held in place within the mold. Although member 34 may be made in various configurations to fit specific cleaning tools, it is illustrated in the drawings as having an elongated straight portion 38, a curved portion 39, and a straight portion 40 which is at an angle of about 135 degrees to portion 38. A ridge 41 may be provided on portion 40 to help lock in the member 34, and may be used to help in swiveling the member within the body. The portion 38 is designed so that it may be inserted into the wand 42 of the power cleaning tool 17 shown in FIG. 1, or into a non-powered cleaning device, such as a brush, a crevice cleaner, or a venetion blind cleaner. Insertion into the wand 42 may be facilitated by the tapered end 43, and locking may be accomplished by a spring-loaded button 44, or similar device.

The opposite end of the body 37 has a reduced diameter portion 45 having a slightly raised and rounded lip 46. The portion 45 is adapted to be interlocked with the internal opening 47 of the hose connector 26, and may be locked into place by interaction of the lip 45 and a groove 48 which is formed into the opening 47. At the same time the electrical interlocking member or plug 35 is received into a corresponding opening 49 in the hose connector. Plug 35 has a pair of metal prongs 50 and 51. The plug is made of a polymeric material which may have any of several designs. For purposes of the example shown, the plug may be similar to that shown in FIGS. 2, 3 and 4 of the Kleykamp et al patent referred to above, and has a pair of resilient shoulders 52 which may be laterally compressed when inserted into the opening 49 of the connector, then allowed to snap out and engage corresponding shoulders in the opening as more fully detailed in the Kleykamp et al patent. At the same time, the prongs 50 and 51 are received by a pair of tubular metal pins 53 in order to provide electrical continuity. Pins 53 are secured in a manner known in the art to appropriate portions of wires 27 and 28, within the hose connector 26, by means of connecting wires 54 and 55.

The prong 50 of the plug 35 is attached to one end of a switch 56 which is incorporated within the body 37 of the adapter 20. This switch may be of any type which is known in the art and which may be convenient for the present purpose; namely, to control power from the canister to the motor P in the power cleaning tool 17. In the example shown, the switch comprises a button 57 which may be slid laterally so that an attached member (not shown) completes a contact between terminal posts secured to prong 50, and to a tubular metal plug 62 which constitutes part of the plug 6 that is also incorporated within the body 37. The switch is shown in the drawings in the "off" position. the other prong 51 of the plug 35 is electrically connected to a tubular metal plug 64 that is also part of plug 36. As indicated above, the switch 56 may be of other types, such as a toggle, push, rotary, or a multiple-position for high and low power, as set forth in the Wickham et al patents.

To complete electrical continuity to the power cleaning tool, this may be accomplished in a simple manner at the same time as the insertion of portion 38 of the air-conducting member 34 into the wand 42 of the power cleaning tool. The tool normally has a cord assembly 65 terminating in a male plug 66, having prongs 67 providing electrical continuity through the cord assembly to motor P. The plug 66 is inserted into corresponding opening 68 in the plug 36 so that the prongs 67 are inserted into the tubular plugs 62 and 64. The electrical continuity is thus complete, as shown in the wiring diagram of FIG. 4, so that power to the power cleaning tool 17 is now controlled by the switch 56 located in the adapter.

MODIFICATION

The preferred embodiment of the invention, as set forth above, relates to control of the power to the power cleaning tool. In such an embodiment, a conventional no-off switch, such as a foot-operated switch illustrated in the Hetland patents, is used to control power to the vacuum cleaner. When operating the system, therefore, the switches will be in two different locations.

It may be advantageous to locate both switches in the same area where the operator of the system can control both motors more conveniently. This can be done according to the present invention by incorporating a three-way switch in the adapter in a manner similar to the two-way switch 56. The switch is wired into the system so that any of the following can occur:

a. Vacuum cleaner motor and cleaning tool motor OFF.
b. Both motors ON.
c. Vacuum cleaner motor ON, cleaning tool motor OFF.

Figure 4:
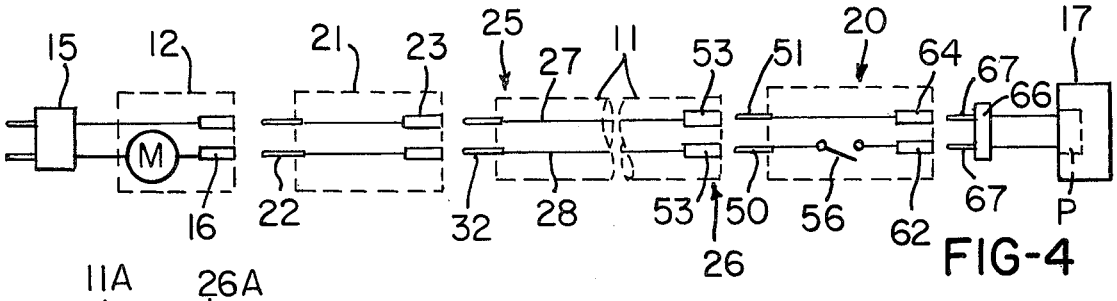
FIG. 4 is a wiring diagram for the electrical circuit whereby the switch controls the power cleaning tool.
Figure 5:
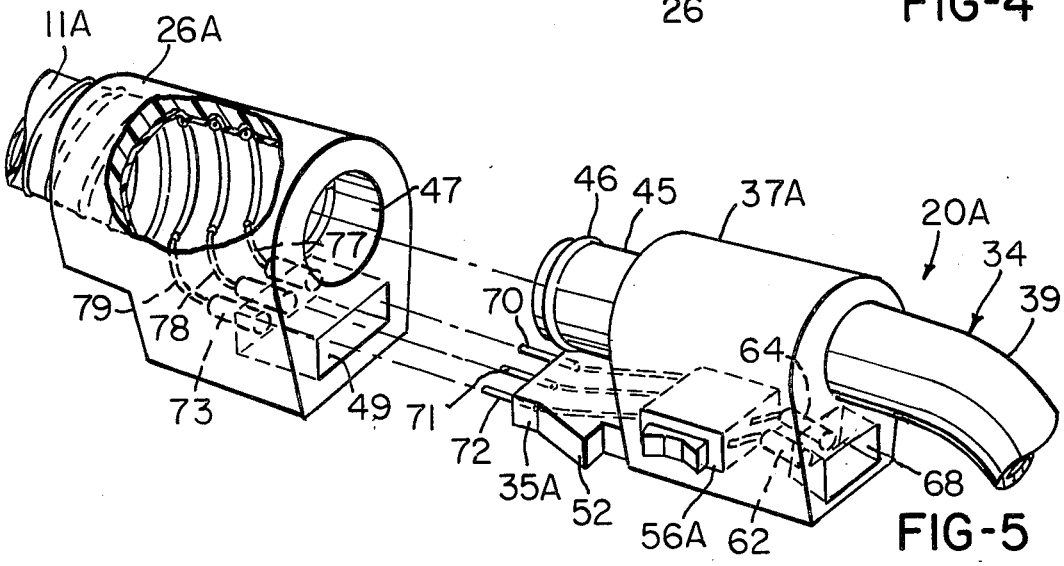
FIG. 5 is an enlarged sectional view of a modified form of the invention, illustrating a multiple position switch for controlling power to the vacuum cleaner motor as well as to the power cleaning tool.
Figure 6:
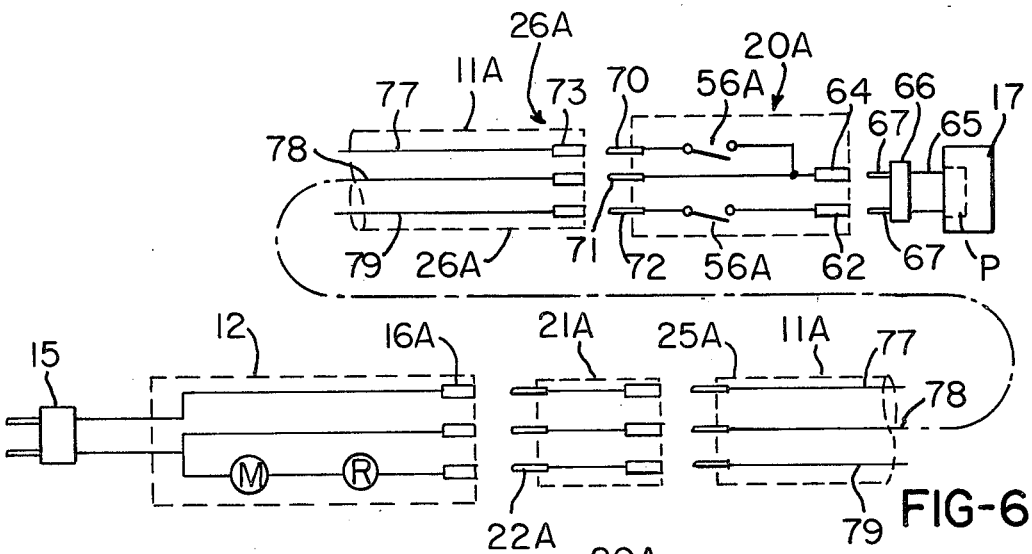
FIG. 6 is a wiring diagram for the electrical circuit for the modified form of the invention shown in FIG. 6.

The modified form of the invention is best illustrated in FIG. 5, which is similar to FIG. 3, and in the wiring diagram of FIG. 6, which is similar to FIG. 4. The overall arrangement of the components is similar to the showing of FIGS. 1 and 2, except for the specific details.

An adapter 20A is similar to adapter 20, and has the same air-conducting member 34 incorporated into a body 37A similar to body 37, and is inserted into the wand 42 of the cleaning tool 17 in the same way. The reduced diameter portion 45 is the same, and is interlocked with opening 47 of the hose connection in the same manner as in the principal embodiment. An electrical interlocking plug 35A is structurally the same as plug 35, and is also incorporated in the body, except that the plug 35A has three metal prongs designated by reference numerals 70, 71 and 72, similar to prongs 50 and 51 of the plug 35. These prongs are received by three tubular metal pins 73 which are similar to pins 53 to provide electrical continuity from the adapter. The pins 73 are secured within the hose connector 26A to reinforcing coils 77, 78 and 79 of the hose assembly 11A; the hose assembly being constructed like hose assembly 11 except that it now contains the three wire coils acting as both reinforcing members and electricl conductors. The third wire is necessary to provide the dual switching arrangement of this modification.

The prongs 70, 71 and 72 are attached to three different terminals of the switch 56A which is incorporated within body 37A of the adapter 20A. This switch may be of any convenient 3-way type which will create the above three conditions. The details of the switch will not be described, but is of a design known in the art. Plug 36 and its plugs 62 and 64 are the same as in the principal form of the invention.

Electrical continuity is thus completed to the power cleaning tool in the same manner as before; namely by inserting plug 66 into opening 68 so that prongs 67 fit into tubular plugs 62 and 64. Electrical continuity is made through connector 26A, hose assembly 11A, connector 25A, cord assembly 21A, male fitting 22A, receptacle 16A, and to motor M via relay R. With this arrangement, therefore, placing the switch 56A in one position interrupts power to both the vacuum cleaner motor M and the power tool motor P; this is OFF. Moving the switch into the middle position closes contact to the vacuum cleaner motor M only, so that the vacuum system operates but no power is supplied to the cleaning tool. Moving the switch to the third position closes the contacts to both motors. The wiring diagram of FIG. 6 illustrates the arrangement described above.

It is also possible to control the vacuum cleaner motor only. This can be done very simply by utilizing the arrangement of FIGS. 2, 3 and 4, in which case the switch is tied in to motor M instead of motor P. This would be useful if a system without a power brush is utilized.

SECOND MODIFICATION

Figure 7:
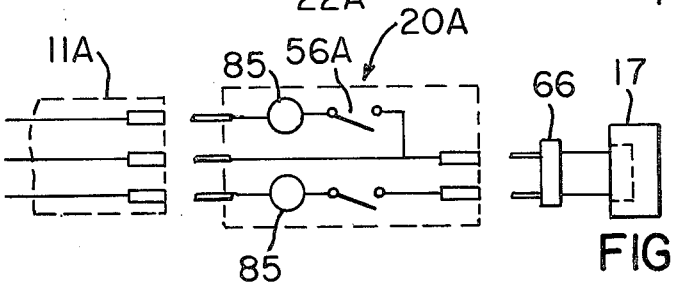
FIG. 7 is a wiring diagram for a further modified form of the invention, illustrating a portion of a wiring diagram similar to the diagram of FIG. 6, wherein a ground fault circuit interrupter device is included in the wiring system to both motors.

It may be desirable to incorporate special protective devices either in the control circuit for the powered cleaning tool or for the vacuum cleaner motor, or both. Such a device may be a ground fault circuit interrupter which is sensitive to and capable of detecting practically every type of fault capable of causing injury to humans, the device operating to interrupt a circuit upon detection of such a fault. the detailed construction of such a device is disclosed in U.S. Pat. No. 3,493,815 to Hurtle. Its use in a vacuum cleaning system is set forth in Somers U.S. Pat. No. 4,283,594 but within a hose connector. The details of these two patents are hereby incorporated by reference and will not be repeated. Physically, the device will be installed in an adapter such as 20 or 20A by molding it therein at the same time as the other components, which represents a distinction over the location of the device in the Somers patent. Electrically, the device is wired into the circuit in series with each or both switches, as shown diagrammatically in FIG. 7. In this figure, only a part of the wiring arrangement is shown as it relates to the switches, it being understood that the remainder of the wiring is like that of FIG. 6 or FIG. 4. The ground fault circuit interrupter is designated by reference number 85.

While exemplary embodiments of the invention and methods of practicing same have been illustrated and described, it should be recognized that the invention may otherwise be embodied and practiced within the scope of the following claims.

We claim:

1. In a vacuum cleaning system comprising a vacuum cleaner, a hose assembly, a cleaning tool adapter and a cleaning tool; said hose assembly comprising a flexible cylindrical body, a plurality of spaced helically coiled reinforcing wires extending along said body and also serving as electrical conductors, and a hose connector at each end of said hose assembly, one of said connectors providing mechanical and electrical continuity between said hose and said vacuum cleaner; the improvement wherein said adapter is separate from said hose assembly and comprises electrical control means for controlling said vacuum cleaning system, and means interlocking said adapter with the other of said hose connectors and providing for repeated connection and disconnection therewith and electrical continuity from said electrical control means through said hose assembly to said vacuum cleaner.

2. The system of claim 1 wherein said control means comprises an on-off switch for said cleaning tool.

3. The system of claim 2 wherein said control means further comprises means being sensitive to and serving to detect practically every type of fault capable of causing injury to humans and operating to interrupt said electrical continuity upon detection of a fault.

4. The system of claim 1 wherein said control means comprises an on-off switch for said vacuum cleaner.

5. The system of claim 1 wherein said control means comprises on-off switch means for said cleaning tool and said vacuum cleaner.

6. The system of claim 5 wherein said control means further comprises means being sensitive to and serving to detect practically every type of fault capable of causing injury to humans and operating to interrupt said electrical continuity upon detection of a fault, said fault detecting means being located in electrical circuits to both said cleaning tool and said vacuum cleaner.

7. In a connect-disconnect hose and cleaning tool adapter assembly for a vacuum cleaning system including a vacuum cleaner, said assembly comprising a hose and an adapter; the improvement wherein said adapter is separate from said hose and comprises electrical control means incorporated therein for controlling said system, and means providing for repeated connection and disconnection of said adapter to said hose and providing electrical continuity therebetween.

8. The assembly of claim 7 wherein said control means comprises an on-off switch for said cleaning tool.

9. The assembly of claim 8 wherein said control means further comprises means being sensitive to and serving to detect practically every type of fault capable of causing injury to humans and operating to interrupt said electrical continuity upon detection of a fault.

10. The assembly of claim 7 wherein said control means comprises an on-off switch for said vacuum cleaner.

11. The assembly of claim 7 wherein said control means comprises on-off switch means for said cleaning tool and said vacuum cleaner.

12. The assembly of claim 7 wherein said adapter includes means for mechanically interconnecting to a cleaning tool, and separate means for providing electrical continuity thereto.

13. In a vacuum cleaning tool adapter for a vacuum cleaning system including a vacuum cleaner and a hose assembly; the improvement wherein said adapter is separate from said hose assembly and comprises electrical control means for controlling said system, and repeated connecting and disconnecting means for mechanically interlocking said adpater to said hose assembly and providing electrical continuity thereto.

14. The adapter of claim 13 wherein said control means comprises an on-off switch for said cleaning tool.

15. The adapter of claim 14 wherein said control means further comprises means being sensitive to and serving to detect practically every type of fault capable of causing injury to humans and operating to interrupt said electrical continuity upon detection of a fault.

16. The adapter of claim 13 wherein said control means comprises an on-off switch for said vacuum cleaner.

17. The adapter of claim 13 wherein said control means comprises on-off switch means for said cleaning tool and said vacuum cleaner.

18. The adapter of claim 17 wherein said control means further comprises means being sensitive to and serving to detect practically every type of fault capable of causing injury to humans and operating to interrupt said electrical continuity upon detection of a fault, said fault detecting means being located in electrical circuits to both said cleaning tool and said vacuum cleaner.

19. The adapter of claim 13 wherein said adapter includes means for mechanically interconnecting to a cleaning tool, and separate means for providing electrical continuity thereto.

20. The adapter of claim 13 comprising a body and an air-conducting member mechanically interengaged with said body, said electrical control means and said mechanically interlocking means incorporated within said body.

21. The adapter of claim 20 wherein said means providing electrical continuity to said hose assembly are also incorporated within said body.

22. The adapter of claim 20 further comprising means providing electrical continuity to a cleaning tool, said means also incorporated within said body.

23. The adapter of claim 22 wherein said adapter includes means for mechanically interconnecting to said cleaning tool.

24. The adapter of claim 20 wherein said body is made of a polymeric material.

25. The adapter of claim 24 wherein said air-conducting member is incorporated into said body.

26. The adapter of claim 20 wherein said adapter further comprises means for providing electrical continuity to a cleaning tool; said electrical control means, said means for interlocking said adapter to said hose assembly, and said means for providing electrical continuity to said cleaning tool, all incorporated within said body.

27. The adapter of claim 26 wherein said means for interlocking said adapter to said hose assembly is located at one end of said adapter, and said means for providing electrical continuity to said cleaning tool is located at the opposite end of said adapter.

* * * * *